US012631362B2

(12) United States Patent
Poos et al.

(10) Patent No.: US 12,631,362 B2
(45) Date of Patent: May 19, 2026

(54) METHOD AND SYSTEM TO REDUCE BROWNOUT CONDITIONS FOR WALL THERMOSTATS

(71) Applicant: Haier US Appliance Solutions, Inc., Wilmington, DE (US)

(72) Inventors: Andrew Poos, Louisville, KY (US); Craig Benjamin Williams, Louisville, KY (US); Malcolm Jessee, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 336 days.

(21) Appl. No.: 18/344,595

(22) Filed: Jun. 29, 2023

(65) Prior Publication Data

US 2025/0003622 A1 Jan. 2, 2025

(51) Int. Cl.
*F24F 11/65* (2018.01)
*F24F 11/56* (2018.01)
*F24F 1/02* (2019.01)

(52) U.S. Cl.
CPC ..... *F24F 11/65* (2018.01); *F24F 11/56* (2018.01); *F24F 1/02* (2013.01)

(58) Field of Classification Search
CPC .... F24F 11/65; F24F 11/56; F24F 1/02; F24F 11/30; F24F 11/88; G05D 23/24; G05D 23/275; F23N 5/203; H02M 5/12
See application file for complete search history.

(56) References Cited

U.S. PATENT DOCUMENTS 3,242,978 A 3/1966 Mcgann
3,768,545 A * 10/1973 Wills ..... G05D 23/1928 165/290
4,038,061 A * 7/1977 Anderson ..... F24F 11/88 361/22
4,167,966 A * 9/1979 Freeman ..... F24F 11/74 165/254
4,433,718 A * 2/1984 Bresin ..... G05D 23/275 165/238
4,843,301 A * 6/1989 Belanger ..... H02M 1/10 323/224
5,687,068 A 11/1997 Jamieson et al.
6,348,782 B1 * 2/2002 Oughton, Jr. ..... H02J 9/062 323/284

(Continued)

*Primary Examiner* — Alicia M. Choi
(74) *Attorney, Agent, or Firm* — Dority & Manning, P.A.

(57) ABSTRACT

An air conditioning system is provided. The air conditioning system can include an air conditioner unit having a linear transformer and a switching circuit. The linear transformer can include a plurality of primary windings and at least one secondary winding, and the switching circuit can be coupled to the plurality of primary windings. The air conditioning system can include a remote user interface coupled to the at least one secondary winding and a controller operably coupled to the air conditioner unit and the remote user interface. The controller can be configured to control output voltage from the air conditioner unit to the remote user interface by monitoring one or more operational parameters of the air conditioning system, determining a selected winding of the plurality of primary windings based at least in part on the one or more operational parameters, and configuring the linear transformer to operate with the selected winding.

19 Claims, 17 Drawing Sheets

(56) References Cited

U.S. PATENT DOCUMENTS

| | | | | |
|---|---|---|---|---|
| 10,353,412 | B2 | 7/2019 | Fernandez et al. | |
| 11,118,794 | B1 * | 9/2021 | Longenecker | F24F 1/0093 |
| 2007/0075700 | A1 * | 4/2007 | Nakahori | H01F 30/10 323/355 |
| 2008/0094859 | A1 * | 4/2008 | Takayanagi | H02M 7/53871 363/17 |
| 2009/0099697 | A1 * | 4/2009 | Li | H02J 9/061 700/276 |
| 2009/0243535 | A1 | 10/2009 | Erdmann et al. | |
| 2009/0251925 | A1 * | 10/2009 | Usui | H02M 3/33561 363/16 |
| 2013/0107401 | A1 * | 5/2013 | Helt | F24F 11/84 361/33 |
| 2019/0277527 | A1 * | 9/2019 | Muniganti | F24F 11/58 |
| 2020/0057461 | A1 * | 2/2020 | Schaar | G05F 1/20 |

* cited by examiner

METHOD AND SYSTEM TO REDUCE BROWNOUT CONDITIONS FOR WALL THERMOSTATS

FIELD

Example aspects of the present disclosure generally relate to air conditioning systems and, more particularly, to systems and methods for reducing brownout conditions in air conditioning systems.

BACKGROUND

Air conditioner units or air conditioning appliance systems are conventionally utilized to adjust the temperature within structures such as dwellings and office buildings. In particular, one-unit type room air conditioner units, such as single-package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

Air conditioner units or air conditioning appliance systems are typically connected to a local thermostat and/or a wall thermostat. The thermostat(s) can measure a temperature of air in an associated room and regulate operation of the air conditioner unit based upon the measured temperature. The thermostat(s) can be connected to the air conditioner unit by wiring that runs through walls of the associated room. The thermostat(s) can also be wirelessly connected to the air conditioner unit over a network.

SUMMARY

Aspects and advantages of embodiments of the present disclosure will be set forth in part in the following description, or can be learned from the description, or can be learned through practice of the embodiments.

One example aspect of the present disclosure is directed to an air conditioning system having an air conditioner unit, a remote user interface, and a controller operably coupled to the air conditioner unit and the remote user interface. The air conditioner unit can include a linear transformer having a plurality of primary windings and at least one secondary winding. The plurality of primary windings can define a primary side of the air conditioning system, and the at least one secondary winding can define a secondary side of the air conditioning system. The air conditioner unit can further include a switching circuit coupled to the plurality of primary windings. The remote user interface can be coupled to the at least one secondary winding. The controller can be configured to control output voltage from the air conditioner unit to the remote user interface by performing operations. The operations can include monitoring one or more operational parameters of the air conditioning system, determining a selected winding of the plurality of primary windings based at least in part on the one or more operational parameters, and configuring the linear transformer to operate with the selected winding.

Another example aspect of the present disclosure is directed to a method for controlling an air conditioning system. The air conditioning system can include an air conditioner unit and a remote user interface; the air conditioner unit can include a linear transformer and a switching circuit. The method can include monitoring, via a controller of the air conditioning system, one or more operational parameters of the air conditioning system. The method can further include determining, via the controller, a selected winding of a plurality of primary windings of the linear transformer based at least in part on the one or more operational parameters. The method can further include configuring the linear transformer to operate with the selected winding.

Another example aspect of the present disclosure is directed to a control system for an air conditioning system. The air conditioning system can include an air conditioner unit and a remote user interface; the air conditioner unit can include a linear transformer and a switching circuit. The control system can be configured to reduce brownout conditions in the air conditioning system by performing operations. The operations can include monitoring one or more operational parameters of the air conditioning system. The operations can further include determining, via the controller, a selected winding of a plurality of primary windings of the linear transformer based at least in part on the one or more operational parameters. The operations can further include configuring the linear transformer to operate with the selected winding.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

Figure 1:
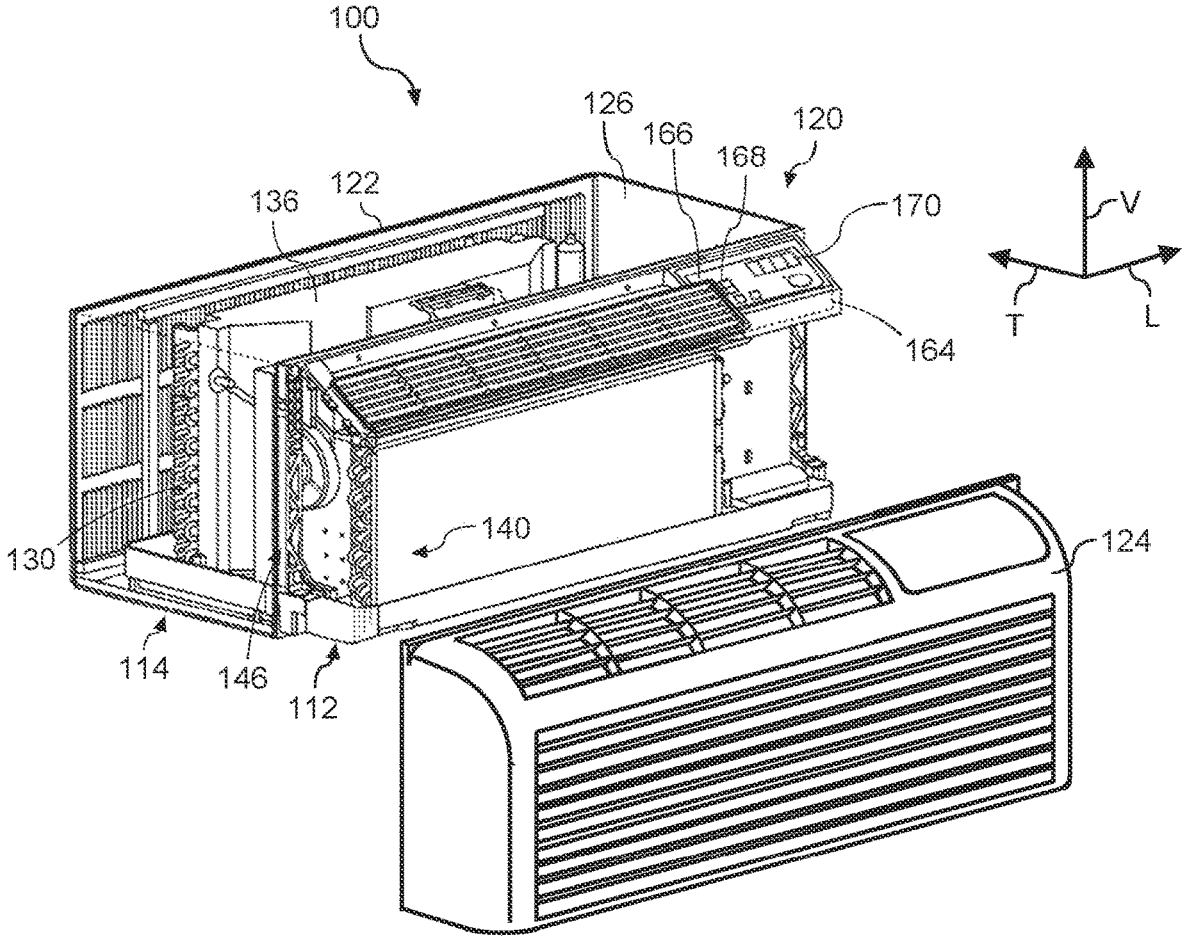
FIG. 1 depicts a perspective view of an example air conditioner unit, with part of an indoor portion exploded from a remainder of the air conditioner unit for illustrative purposes, according to example embodiments of the present disclosure.

Repeat use of reference characters in the present specification and drawings is intended to represent the same and/or analogous features or elements of the present invention.

DETAILED DESCRIPTION

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure generally relate to systems and methods for controlling operation of air conditioning systems. In particular, example aspects of the present disclosure provide an air conditioning system having an air conditioner unit and a remote user interface (e.g., thermostat). In some embodiments, the air conditioner unit is a package terminal air conditioner (PTAC). In other embodiments, the air conditioner unit is a single-package vertical unit (SPVU). However, the systems and methods disclosed are by no means limited exclusively to PTACs and/or SPVUs and can be applied to any suitable air conditioning system having an air conditioner unit.

According to example aspects of the present disclosure, the air conditioner unit can include, inter alia, a linear transformer having a plurality of primary windings and at least one secondary winding. The air conditioner unit can further include a switching circuit coupled to the plurality of primary windings of the linear transformer. Additionally, the remote user interface can be coupled to the at least one secondary winding of the linear transformer. The air conditioning system can further include a control system (e.g., controller) operably coupled to the air conditioner unit and the remote user interface. The controller can be configured to control output voltage from the air conditioner unit to the remote user interface in order to reduce brownout conditions in the air conditioning system.

A brownout condition is defined as a decrease (e.g., typically greater than a 10% decrease) in power supply to the air conditioning system. Typically, thermostats in air conditioning systems can suffer brownout conditions due to two main factors relating to high line input voltages and low line input voltages. For example, high line voltages can cause the linear transformer in the air conditioner unit to self-heat and, in response, drop the output voltage to the thermostat below its rated minimum input voltage. Likewise, low line voltages can lead to brownout conditions when the thermostat turns on the signal relays which, in turn, loads down the output voltage from the air conditioner unit and causes it to fall below the minimum input voltage rating of the thermostat.

Brownout conditions can result in costly and significant damages to air conditioning systems. For example, brownout conditions can severely damage crucial components of air conditioning systems such as, e.g., compressors, evaporators, condensers, etc., and can even fry electrical components such as, e.g., transformers, relays, contactors, etc. Furthermore, brownout conditions often result in the air conditioner unit and the thermostat being unable to modulate input voltage to the thermostat. In some cases, brownout conditions can render the entire air conditioning system useless and inoperable. As a result, brownout conditions often lead to service calls by consumers due to the resulting malfunctioning of the air conditioning systems.

While these brownout conditions are not uncommon, conventional air conditioning systems are not able to dynamically adjust to varying voltage conditions. Rather, conventional air conditioning systems use a variety of devices and/or methods to protect against brownouts such as, e.g., surge protectors, voltage regulators, uninterruptible power supplies, etc. However, these preventative measures are costly and oftentimes require extra (e.g., third-party) components not included in the air conditioning system. As such, an air conditioning system and method that controls output voltage from an air conditioner unit to a thermostat in order to reduce brownout conditions is desired.

Accordingly, example aspects of the present disclosure provide an air conditioning system having a controller configured to control output voltage from an air conditioner unit to a remote user device thereby reducing brownout conditions. More particularly, the air conditioner unit includes a linear transformer having a plurality of primary windings and at least one secondary winding. The air conditioner unit further includes a switching circuit coupled to the plurality of primary windings and to the controller. The controller is configured to control operation of the air conditioning system by determining a selected winding of the plurality of primary windings for use by the air conditioner unit based on various operational parameters. For instance, the selected winding can be determined based, at least in part, on definition data associated with the air conditioning system and/or user-defined operational parameters stored in memory. As will be discussed in greater detail below, the controller can be configured to store definition data associated with the air condition system and/or user-defined operational parameters in a memory.

Additionally and/or alternatively, the air conditioning system can further include a voltage detection circuit coupled to a primary side of the air conditioning system and/or a secondary side of the air conditioning system. The voltage detection circuit can be coupled to the controller, and the controller can be configured to determine the selected winding based, at least in part, on data received from the voltage detection circuit. Furthermore, in response to determining the selected winding, the controller is configured to transmit one or more control signals to the switching circuit in order to control the switching circuit to select the selected winding. In this way, the controller is configured to control the output voltage from the air conditioner unit to the remote user interface, thereby reducing brownout conditions in the air conditioning system (e.g., in the remote user interface).

Example aspects of the present disclosure provide numerous technical effects and benefits. For instance, example aspects of the present disclosure provide systems and methods capable of dynamically adjusting to varying voltage conditions. By providing a controller configured to adjust a selected winding of the plurality of primary windings of the linear transformer based on a variety of operational parameters, the systems and methods provided herein are capable of reducing the brownout conditions that have long plagued consumers and owners of air conditioning systems. Furthermore, example aspects of the present disclosure provide for reliable and consistent air conditioning systems while, at the same time, minimizing the costs associated with repairs and maintenance of those systems.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (e.g., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the Figures, FIGS. 1-6 depict various views of an example air conditioner unit 100 according to example embodiments of the present disclosure. The air conditioner unit 100 depicted in FIGS. 1-6 is a one-unit-type air conditioner unit, also conventionally referred to as a room air conditioner and/or a packaged terminal air conditioner (PTAC). However, it should be appreciated that aspects of the present disclosure may also utilize other suitable air conditioner units such as, e.g., single package vertical units (SPVU), split heat pump systems, etc. without deviating from the scope of the present disclosure.

Referring now to FIG. 1, a perspective view of the example air conditioner unit 100 is depicted. The unit 100 includes an indoor portion 112 and an outdoor portion 114, and generally defines a vertical direction V, a lateral direction L, and a transverse direction T. Each direction V, L, T is perpendicular to each other, such that an orthogonal coordinate system is generally defined.

A housing 120 of the unit 100 may contain various other components of the unit 100. Housing 120 may include, for example, a rear grill 122 and a room front 124 which may be spaced apart along the transverse direction T by a wall sleeve 126. The rear grill 122 may be part of the outdoor portion 114, and the room front 124 may be part of the indoor portion 112. Components of the outdoor portion 114, such as an outdoor heat exchanger 130, an outdoor fan 132 (FIG. 2), and a compressor 134 (FIG. 2) may be housed within the wall sleeve 126. A casing 136 may additionally enclose outdoor fan 132, as shown.

Figure 2:
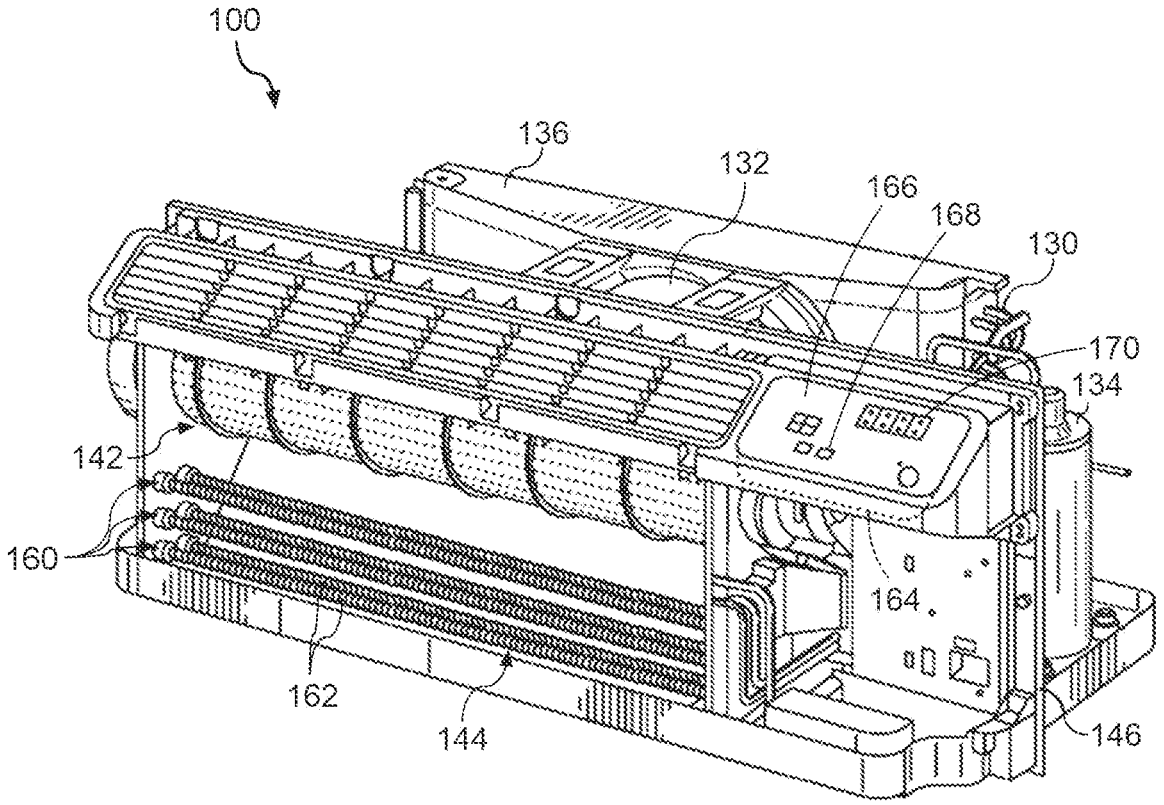
FIG. 2 depicts a perspective view of components of the indoor portion of the example air conditioner unit of FIG. 1 according to example embodiments of the present disclosure.

Referring now also to FIG. 2, a perspective view of components of the indoor portion 112 of air conditioner unit 100 is illustrated. As shown, indoor portion 112 may include, for example, an indoor heat exchanger 140 (FIG. 1), a blower fan 142, and a heating unit 144. These components may, for example, be housed behind the room front 124. Additionally, a bulkhead 146 may generally support and/or house various other components or portions thereof of the indoor portion 112, such as the blower fan 142 and the heating unit 144. Bulkhead 146 may generally separate and define the indoor portion 112 and outdoor portion 114.

Figure 3:
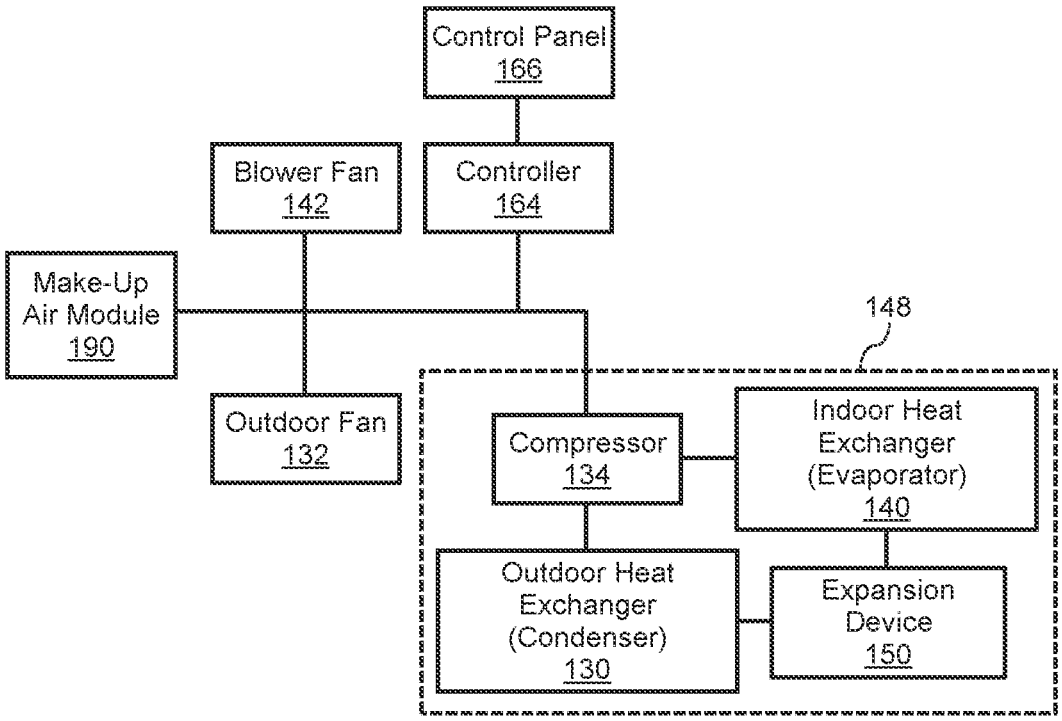
FIG. 3 depicts a schematic view of an example refrigeration loop according to example embodiments of the present disclosure.

Outdoor and indoor heat exchangers 130, 140 may be components of a refrigeration loop 148, which is shown schematically in FIG. 3. Refrigeration loop 148 may, for example, further include compressor 134 and an expansion device 150. As illustrated, compressor 134 and expansion device 150 may be in fluid communication with outdoor heat exchanger 130 and indoor heat exchanger 140 to flow refrigerant therethrough as is generally understood. More particularly, refrigeration loop 148 may include various lines for flowing refrigerant between the various components of refrigeration loop 148, thus providing the fluid communication therebetween. Refrigerant may thus flow through such lines from indoor heat exchanger 140 to compressor 134, from compressor 134 to outdoor heat exchanger 130, from outdoor heat exchanger 130 to expansion device 150, and from expansion device 150 to indoor heat exchanger 140. The refrigerant may generally undergo phase changes associated with a refrigeration cycle as it flows to and through these various components, as is generally understood. Suitable refrigerants for use in refrigeration loop 148 may include pentafluoroethane, difluoromethane, or a mixture such as R410a, although it should be understood that the present disclosure is not limited to such example and rather that any suitable refrigerant may be utilized.

As is understood in the art, refrigeration loop 148 may alternately be operated as a refrigeration assembly (and thus perform a refrigeration cycle) or a heat pump (and thus perform a heat pump cycle). As shown in FIG. 3, when refrigeration loop 148 is operating in a cooling mode and thus performs a refrigeration cycle, the indoor heat exchanger 140 acts as an evaporator and the outdoor heat exchanger 130 acts as a condenser. Alternatively, when the assembly is operating in a heating mode and thus performs a heat pump cycle, the indoor heat exchanger 140 acts as a condenser and the outdoor heat exchanger 130 acts as an evaporator. The outdoor and indoor heat exchangers 130, 140 may each include coils through which a refrigerant may flow for heat exchange purposes, as is generally understood.

According to an example embodiment, compressor 134 may be a variable speed compressor. In this regard, compressor 134 may be operated at various speeds depending on the current air conditioning needs of the room and the demand from refrigeration loop 148. For example, according to an exemplary embodiment, compressor 134 may be configured to operate at any speed between a minimum speed, e.g., 1500 revolutions per minute (RPM), to a maximum rated speed, e.g., 3500 RPM. Notably, use of variable speed compressor 134 enables efficient operation of refrigeration loop 148 (and thus air conditioner unit 100), minimizes unnecessary noise when compressor 134 does not need to operate at full speed, and ensures a comfortable environment within the room.

In exemplary embodiments as illustrated, expansion device 150 may be disposed in the outdoor portion 114 between the indoor heat exchanger 140 and the outdoor heat exchanger 130. According to the exemplary embodiment, expansion device 150 may be an electronic expansion valve that enables controlled expansion of refrigerant, as is known in the art. More specifically, electronic expansion device 150 may be configured to precisely control the expansion of the refrigerant to maintain, for example, a desired temperature differential of the refrigerant across the indoor heat exchanger 140. In other words, electronic expansion device 150 throttles the flow of refrigerant based on the reaction of the temperature differential across indoor heat exchanger 140 or the amount of superheat temperature differential, thereby ensuring that the refrigerant is in the gaseous state entering compressor 134. According to alternative embodiments, expansion device 150 may be a capillary tube or another suitable expansion device configured for use in a thermodynamic cycle.

According to the illustrated exemplary embodiment, outdoor fan 132 is an axial fan and indoor blower fan 142 is a centrifugal fan. However, it should be appreciated that according to alternative embodiments, outdoor fan 132 and blower fan 142 may be any suitable fan type. In addition, according to an exemplary embodiment, outdoor fan 132 and blower fan 142 are variable speed fans. For example, outdoor fan 132 and blower fan 142 may rotate at different rotational speeds, thereby generating different air flow rates. It may be desirable to operate fans 132, 142 at less than their maximum rated speed to ensure safe and proper operation of refrigeration loop 148 at less than its maximum rated speed, e.g., to reduce noise when full speed operation is not needed. In addition, according to alternative embodiments, fans 132, 142 may be operated to urge make-up air into the room.

According to the illustrated embodiment, blower fan 142 may operate as an evaporator fan in refrigeration loop 148 to encourage the flow of air through indoor heat exchanger 140. Accordingly, blower fan 142 may be positioned downstream of indoor heat exchanger 140 along the flow direction of indoor air and downstream of heating unit 144. Additionally and/or alternatively, blower fan 142 may be positioned upstream of indoor heat exchanger 140 along the flow direction of indoor air and may operate to push air through indoor heat exchanger 140.

Heating unit 144 in exemplary embodiments includes one or more heater banks 160. Each heater bank 160 may be operated as desired to produce heat. In some embodiments as shown, three heater banks 160 may be utilized. Additionally and/or alternatively, however, any suitable number of heater banks 160 may be utilized. Each heater bank 160 may further include at least one heater coil or coil pass 162, such as in exemplary embodiments two heater coils or coil passes 162. Additionally and/or alternatively, other suitable heating elements may be utilized.

The operation of air conditioner unit 100 including compressor 134 (and thus refrigeration loop 148 generally) blower fan 142, outdoor fan 132, heating unit 144, expansion device 150, and other components of refrigeration loop 148 may be controlled by a processing device such as, e.g., a controller 164. Controller 164 may be in communication (via for example a suitable wired or wireless connection) to such components of the air conditioner unit 100. As described in more detail below with respect to FIGS. 8-12, the controller 164 may include a memory and one or more processing devices such as microprocessors, CPUs or the like, such as general or special purpose microprocessors operable to execute programming instructions or micro-control code associated with operation of unit 100. The memory may represent random access memory such as DRAM, or read only memory such as ROM or FLASH. In one embodiment, the processor executes programming instructions stored in memory. The memory may be a separate component from the processor or may be included onboard within the processor.

Unit 100 may additionally include a control panel 166 and one or more user inputs 168, which may be included in control panel 166. The user inputs 168 may be in communication with the controller 164. A user of the unit 100 may interact with the user inputs 168 to operate the unit 100, and user commands may be transmitted between the user inputs 168 and controller 164 to facilitate operation of the unit 100 based on such user commands. A display 170 may additionally be provided in the control panel 166 and may be in communication with the controller 164. Display 170 may, for example be a touchscreen or other text-readable display screen, or alternatively may simply be a light that can be activated and deactivated as required to provide an indication of, for example, an event or setting for the unit 100.

Figure 4:
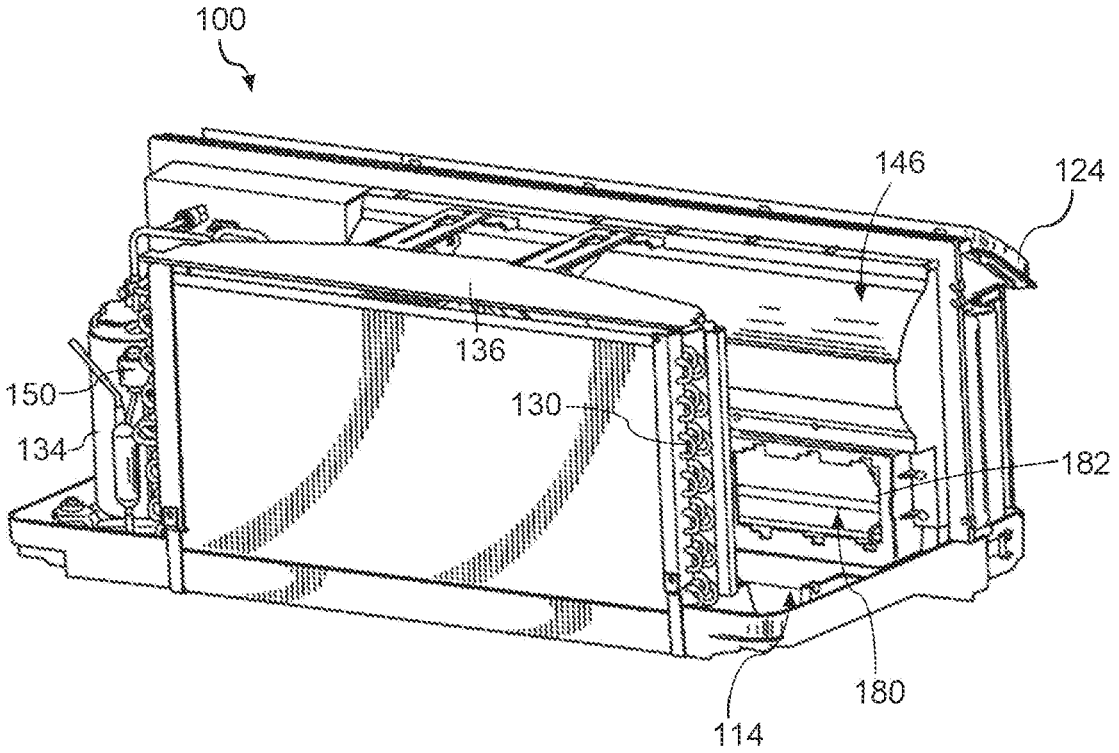
FIG. 4 depicts a rear perspective view of an outdoor portion of the example air conditioner unit of FIG. 1, illustrating a vent aperture in a bulkhead assembly, according to example embodiments of the present disclosure.

Referring briefly to FIG. 4, a perspective view of the outdoor portion 114 of the unit 100 is illustrated. As shown, a vent aperture 180 may be defined in bulkhead 146 providing fluid communication between indoor portion 112 and outdoor portion 114. Vent aperture 180 may be utilized in an installed air conditioner unit 100 to allow outdoor air to flow into the room through the indoor portion 112. In this regard, in some cases it may be desirable to allow outside air (i.e., "make-up air") to flow into the room in order, e.g., to meet government regulations, or to compensate for negative pressure created within the room. In this manner, according to an exemplary embodiment, make-up air may be provided into the room through vent aperture 180 when desired.

Figure 5:
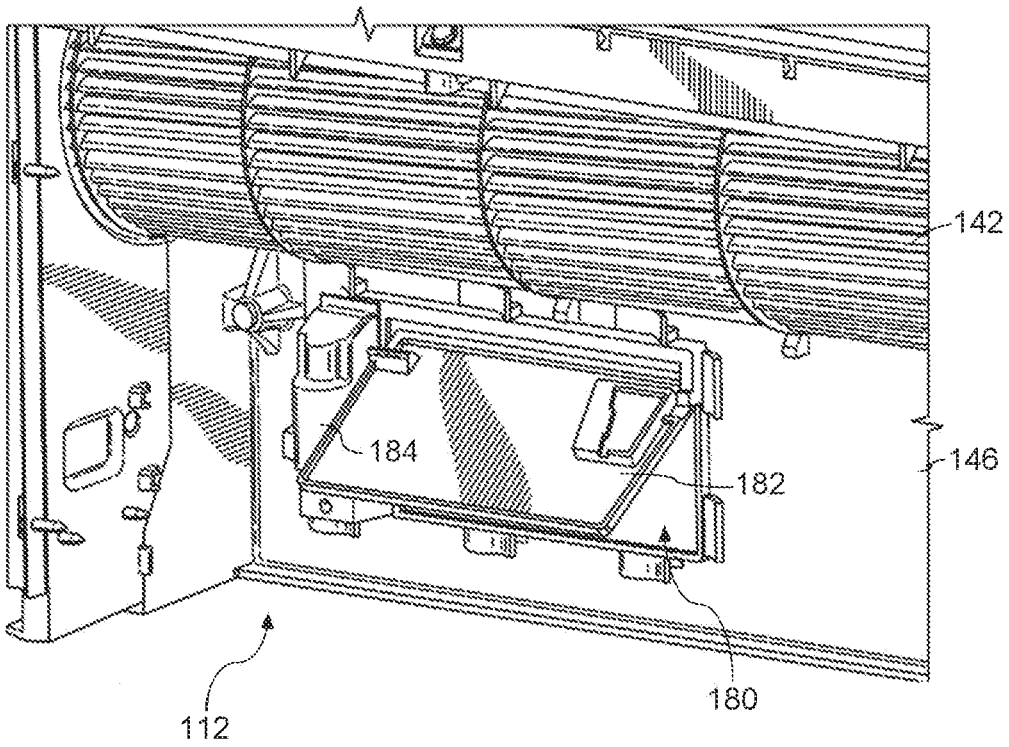
FIG. 5 depicts a front perspective view of the example air conditioner unit and example bulkhead assembly of FIG. 4, with a vent door illustrated in an open position, according to example embodiments of the present disclosure.

Referring briefly to FIG. 5, a front perspective view of the example bulkhead assembly 146 of the unit 100 is illustrated. As shown, a vent door 182 may be pivotally mounted to the bulkhead 146 proximate to vent aperture 180 to open and close vent aperture 180. More specifically, as illustrated, vent door 182 is pivotally mounted to the indoor facing surface of indoor portion 112. Vent door 182 may be configured to pivot between a first, closed position where vent door 182 prevents air from flowing between outdoor portion 114 and indoor portion 112, and a second, open position where vent door 182 is in an open position (as shown in FIG. 5) and allows make-up air to flow into the room. According to the illustrated embodiment vent door 182 may be pivoted between the open and closed position by an electric motor 184 controlled by controller 164, or by any other suitable method.

Figure 6:
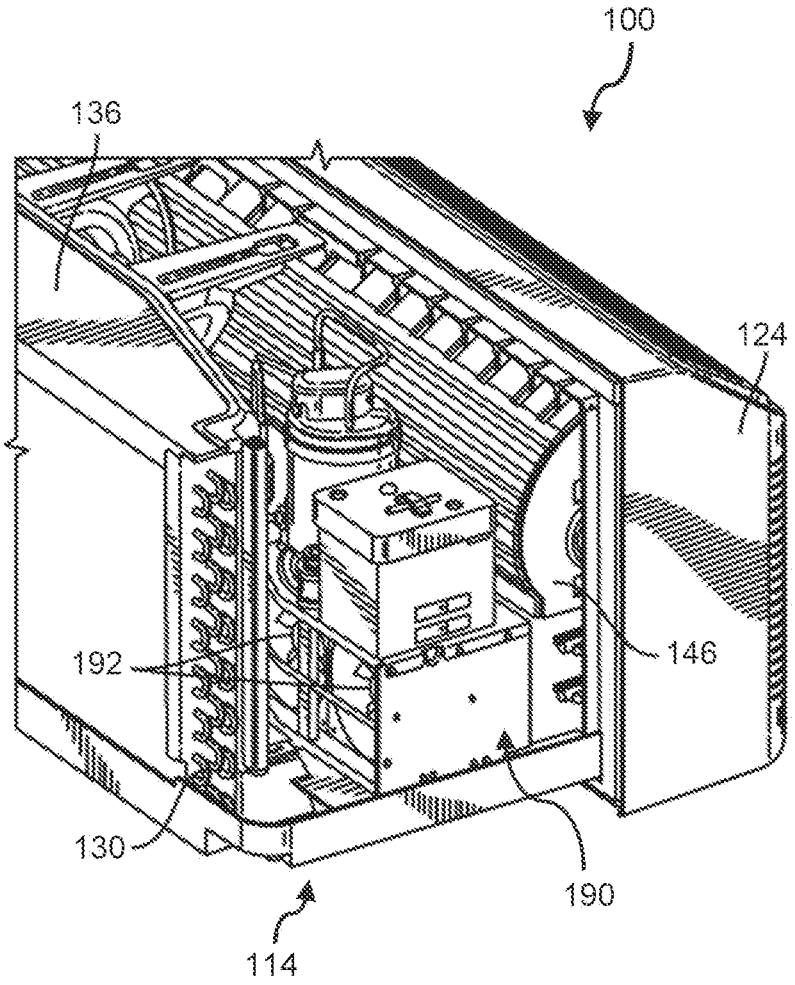
FIG. 6 depicts a rear perspective view of the example air conditioner unit and bulkhead assembly of FIG. 4, including a sealed system for conditioning make-up air, according to example embodiments of the present disclosure.

Referring briefly to FIG. 6, a rear perspective view of the example bulkhead assembly 146 of the unit 100 is illustrated. In some cases, it may be desirable to treat or condition make-up air flowing through vent aperture 180 prior to blowing it into the room. For example, outdoor air which has a relatively high humidity level may require treating before passing into the room. In addition, if the outdoor air is cool, it may be desirable to heat the air before blowing it into the room. Thus, as shown in FIG. 6, unit 100 may further include an auxiliary sealed system 190 (e.g., make-up air module 190) for conditioning make-up air. As shown, make-up air module 190 and/or an auxiliary fan 192 are positioned within outdoor portion 114 adjacent vent aperture 180. Furthermore, vent door 182 is positioned within indoor portion 112 over vent aperture 180, though other configurations are possible. According to the illustrated embodiment, auxiliary sealed system 190 may be controlled by controller 164, by another dedicated controller, or by any other suitable method.

As illustrated, make-up air module 190 includes auxiliary fan 192 that is configured as part of auxiliary sealed system 190 and may be configured for urging a flow of air through auxiliary sealed system 190. Auxiliary sealed system 190 may further include one or more compressors, heat exchangers, and any other components suitable for operating auxiliary sealed system 190 similar to refrigeration loop 148 described above to condition make-up air. For example, auxiliary system 190 can be operated in a dehumidification mode, an air conditioning mode, a heating mode, a fan only mode where only auxiliary fan 192 is operated to supply outdoor air, an idle mode, etc.

Figure 7:
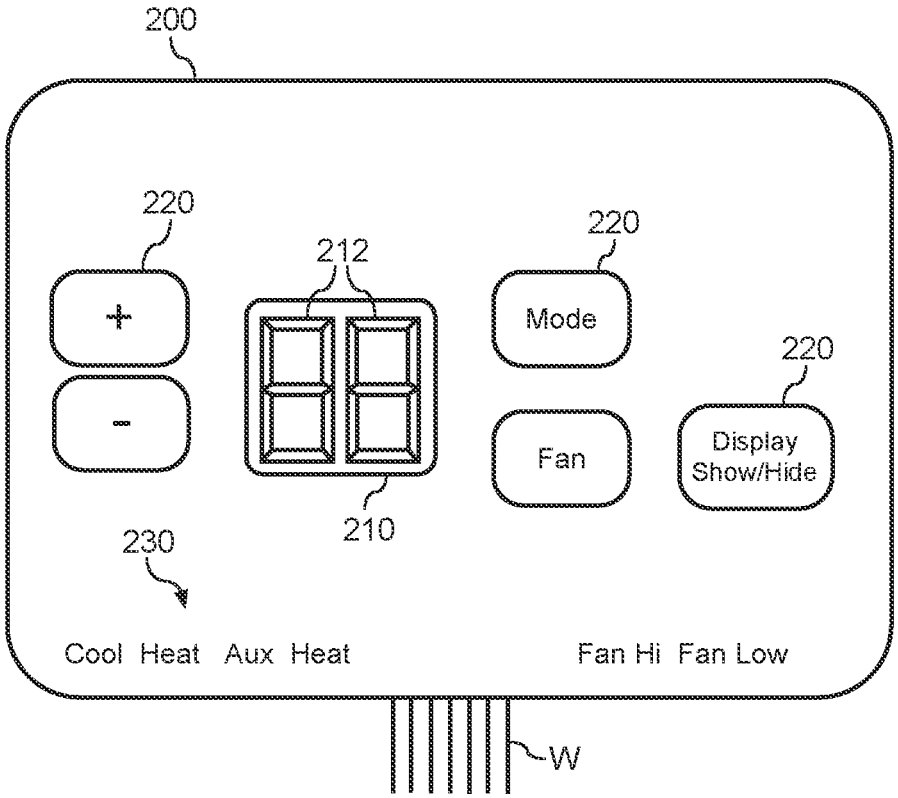
FIG. 7 depicts a front elevation view of an example user interface according to example embodiments of the present disclosure.

FIG. 7 depicts a front, elevation view of a user interface panel 200 (e.g., user interface 200) of air conditioner unit 100 (FIGS. 1-6). As noted above, although the air conditioner unit 100 is depicted as a packaged terminal air conditioner (PTAC) for purposes of illustration and discussion, the user interface panel 200 can be utilized with any suitable type of air conditioner unit such as, e.g., single package vertical units (SPVU), split heat pump systems, etc. without deviating from the scope of the present disclosure. Furthermore, it should be noted that "user interface panel" and "user interface" are used interchangeably herein.

User interface 200 is in operative communication with controller 164. Thus, e.g., a user may input commands at user interface panel 200, and controller 164 may adjust operation of the air conditioner unit 100 in response to command signals from user interface 200. In some embodiments, user interface 200 may be a local user interface, e.g., such that user interface 200 is mounted to bulkhead 146 or some other component of the air conditioner unit 100, and a user may utilize user interface 200 at or adjacent air conditioner unit 100 to adjust operation of air conditioner unit 100. Additionally and/or alternatively, user interface 200 may be a remote user interface, e.g., a wall mounted thermostat, and the user may utilize user interface 200 away from air conditioner unit 100 to adjust operation of air conditioner unit 100.

User interface 200 includes a display 210 and a plurality of input components 220. Input components 220 may be one or more of a variety of touch-type controls, electrical, mechanical or electro-mechanical input devices including knobs, rotary dials, push buttons, touch pads, etc. Display 210 is designed to provide visual feedback to a user of air conditioner unit 100. Display 210 includes a pair of segment displays 212. Segment displays 212 may include no less than seven segments. For example, each segment display 212 may include exactly seven segments in certain example embodiments. Thus, segment displays 212 may be seven segment displays. In alternative example embodiments, segment displays 212 may be nine segment displays, fourteen segment displays, sixteen segment displays, etc. As shown in FIG. 7, segment displays 212 may include exactly two segment displays 212. It should be appreciated, however, that any suitable display 210 can be used such as, e.g., LCD screens, LED screens, vacuum fluorescent displays, dot matrix displays, etc. without deviating from the scope of the present disclosure.

As noted above, user interface 200 may be utilized as a local user interface and/or a remote user interface. In particular, air conditioner unit 100 may include two user interfaces 200, with one of the two user interfaces 200 configured as the local user interface and the other of the two user interfaces 200 configured as the remote user interface. Controller 164 may be in operative communication with both user interfaces 200. For example, wiring W may extend between the one of user interfaces 200 configured as the remote user interface and a terminal connection positioned at controller 164. The wiring W includes a plurality of wires, e.g., with no less than five wires and no more than eight wires. The wiring W may extend within walls in a room within which air conditioner unit 100 is located. Control signals may be transmitted through the wiring W between the remote user interface and controller 164. Thus, a user may regulate operation of air conditioner unit 100 by utilizing the remote user interface despite being located away from controller 164. It should be appreciated that the user interface 200 can be further configured to wirelessly communicate with controller 164.

User interface 200 may also include a plurality of function indicators 230. Function indicators 230 may be backlit text on user interface 200, e.g., such that the text at outer surface of user interface 200 is visible when an LCD or other suitable light emitter is activated within user interface 200. A respective one of function indicators 230 on the local user interface may also be activated in response to receiving the appropriate signal from the remote user interface. Thus, function indicators 230 may complement display 210 on the local user interface in communicating the status of the connection between the one of user interfaces 200 configured as the remote user interface and controller 164.

Figure 8:
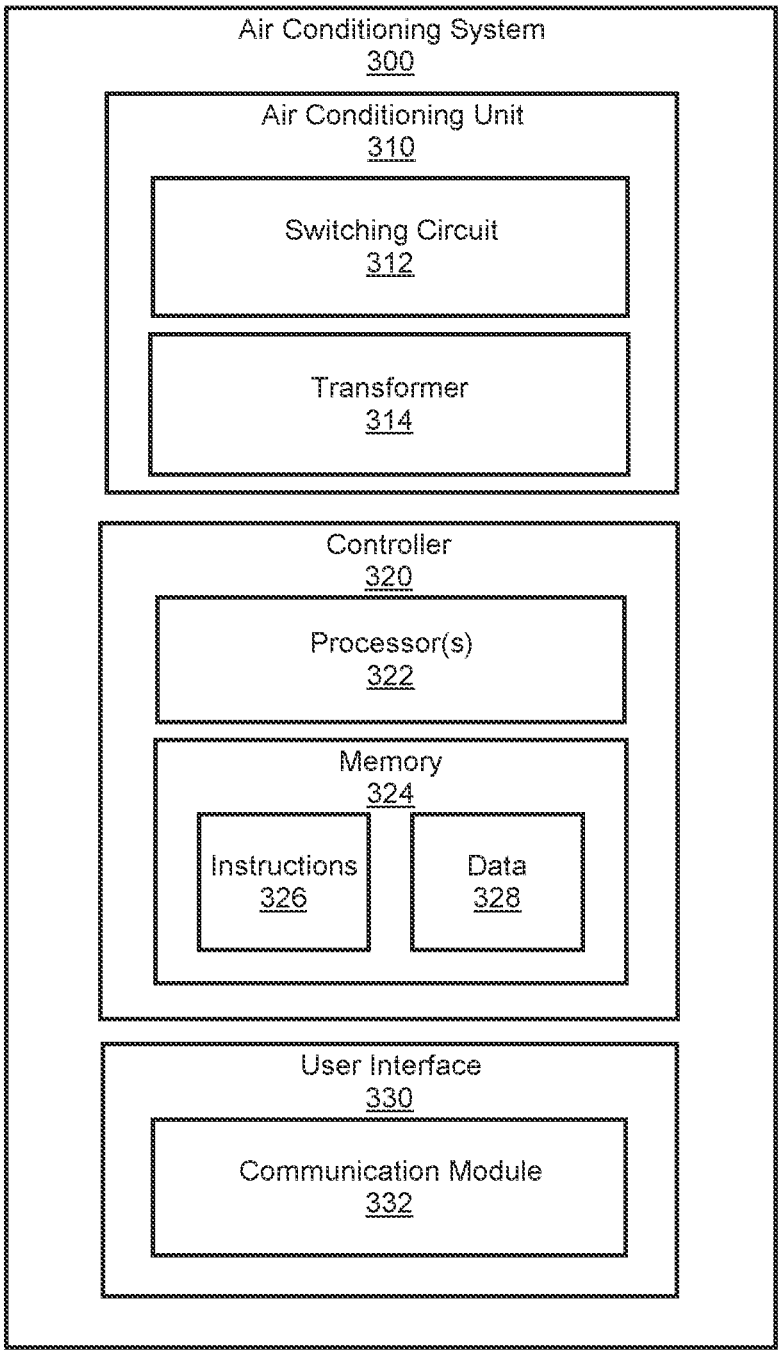
FIG. 8 depicts a block diagram of an example air conditioning system according to example embodiments of the present disclosure.
Figure 9:
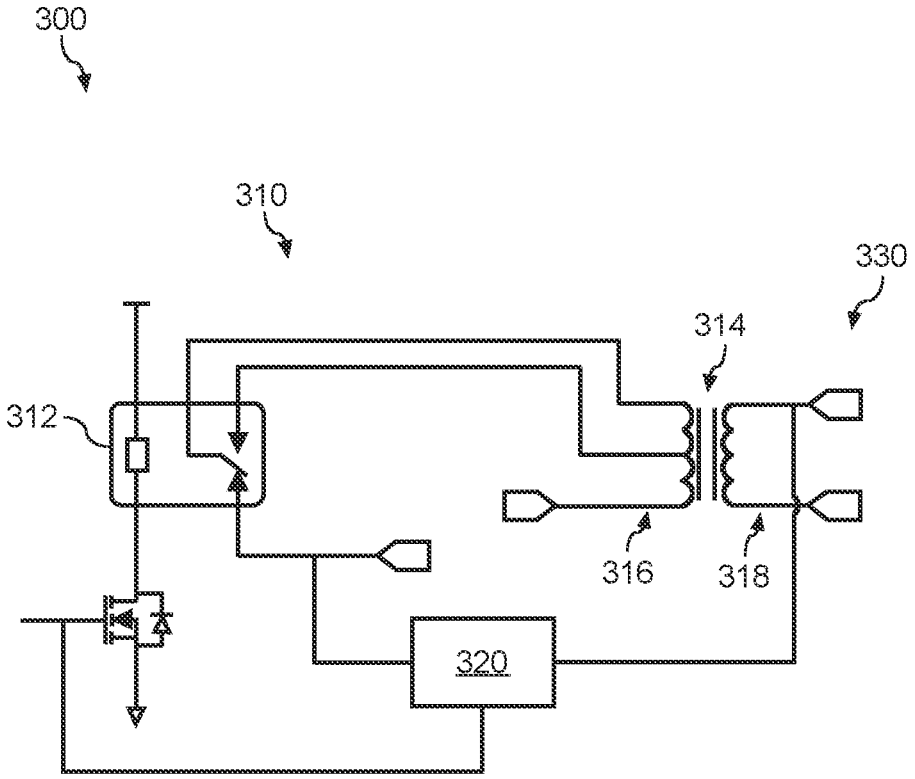
FIG. 9 depicts a circuit schematic diagram of a portion of the example air conditioning system of FIG. 8 according to example embodiments of the present disclosure.

Referring now to FIGS. 8-12, an example air conditioning system 300 is illustrated according to example embodiments of the present disclosure. FIG. 8 depicts a block diagram of the air conditioning system 300; FIG. 9 depicts a circuit schematic diagram of a portion of the air conditioning system 300. It should be appreciated that air conditioning system 300 can include the air conditioner unit 100 discussed above with reference to FIGS. 1-6, as well as the components thereof, and the user interface 200 discussed above with reference to FIG. 7, as well as the components thereof.

As shown in FIGS. 8-9, the air conditioning system 300 can include an air conditioner unit 310. In some embodiments, the air conditioner unit 310 can be a package terminal air conditioner (PTAC) such as, e.g., the air conditioner unit 100 discussed above with reference to FIGS. 1-6. Additionally and/or alternatively, the air conditioner unit 310 can be a single-package vertical unit (SPVU). It should be noted that the air conditioner unit 310 can be any suitable air conditioner unit without deviating from the scope of the present disclosure.

The air conditioner unit 310 can further include a transformer such as, e.g., a linear transformer 314. The linear transformer 314 can include a plurality of primary windings 316 and at least one secondary winding 318. The plurality of primary windings 316 can define a primary side of the air conditioning system 300. Likewise, the at least one secondary winding 318 can define a secondary side of the air conditioning system 300. Although the linear transformer 314 is depicted in FIG. 8 as having two primary windings 316, it should be noted that the linear transformer 314 can include more than two primary windings 316 without deviating from the scope of the present disclosure.

The air conditioning system 300 can further include a switching circuit 312 on the primary side of the air conditioning system 300. More specifically, as shown, the switching circuit 312 can be coupled to the plurality of primary windings 316. As will be discussed in greater detail below, the switching circuit 312 can be configured to switch between (e.g., connect) each of the plurality of primary windings 316 based on a variety of input parameters (e.g., operational parameters).

The air conditioning system 300 can further include a user interface 330 such as, e.g., the user interface panel 200 discussed above with reference to FIG. 7. As shown, the user interface 330 can be located on the secondary side of the air conditioning system 300. More specifically, the user interface 330 can be coupled to the at least one secondary winding 318 of the linear transformer 314. In some embodiments, the user interface 330 can be a local user interface, e.g., such that the user interface 330 is mounted to the air conditioner unit 310, thereby allowing a user to utilize the user interface 330 at or adjacent the air conditioner unit 310 to adjust operation of the air conditioning system 300. Additionally and/or alternatively, the user interface 330 can be a remote user interface such as, e.g., a wall mounted thermostat, thereby allowing the user to utilize the user interface 330 away from the air conditioner unit 310 to adjust operation of the air conditioning system 300.

Furthermore, in some embodiments, the user interface 330 can include a communications module 332. In this way, the user interface 330 can have bidirectional communication capabilities (e.g., send and receive capabilities) with other components of the air conditioning system 300. For instance, in some embodiments, the user interface 330 can be configured for wireless communication with the other components of the air conditioning system 300 and/or components outside air conditioning system 300. Additionally and/or alternatively, the user interface 330 can be configured for wired communication with the other components of air conditioning system 300. It should be noted that the communications module 332 can be any suitable device that provides bidirectional communication capabilities using any suitable communication protocol without deviating from the scope of the present disclosure.

The air conditioning system 300 can further include a control system 320 (e.g., controller 320) operably coupled to the air conditioner unit 310 and the user interface 330. It should be noted that "control system" and "controller" are used interchangeably herein. The controller 320 can include one or more processors 322 and a memory 324. The processor(s) 322 can be communicatively coupled to the air conditioner unit 310 and the user interface 330. In this manner, the processor(s) 322 can send and/or receive signals from the air conditioner unit 310 (e.g., switching circuit 312) and the user interface 330 (e.g., communications module 332).

The memory 324 can be configured to receive and store instructions 326 that, when executed by the processor(s) 322, cause the controller 320 to perform one or more operations (e.g., one or more actions). The instructions 326 can include, e.g., one or more operations described below with respect to FIG. 13 (e.g., method 400). More specifically, as will be discussed in greater detail below, the controller 320 can be configured to control output voltage from the air conditioner unit 310 to the user interface 330—in order to reduce brownout conditions—by performing operations.

For instance, the controller 320 can be configured to monitor one or more operational parameters of the air conditioning system 300 such as, e.g., one or more electrical characteristics of the air conditioning system 300. The controller 320 can be further configured to determine a selected winding of the plurality of primary windings 316 for use by the air conditioner unit 310 based, at least in part, on the one or more operational parameters of the air conditioning system 300. In response to determining the selected winding of the plurality of windings 316, the controller 320 can be configured to configure the linear transformer 314 to operate with the selected winding. For instance, the controller 320 can be configured to generate and transmit a control signal to the switching circuit 312. The control signal can include data indicative of the selected winding of the plurality of primary windings 316 and data instructing the switching circuit 312 to connect the selected winding for use by the air conditioner unit 310.

Furthermore, the memory 324 can be configured to receive and store data 328. For instance, in some embodiments, the data 328 can include definition data corresponding to the air conditioner unit 310 and the user interface 330 such as, e.g., model numbers and corresponding voltage ranges. In some embodiments, the data 328 can include a database (not shown) (e.g., lookup table, matrix, correlation) identifying one or more operational parameters and/or definition information for each component of the air conditioning system 300. In this manner, as will be discussed below, the controller 320 can be configured to determine a selected winding of the plurality of primary windings 316 based, at least in part, on stored definition data associated with the air conditioner unit 310.

Additionally and/or alternatively, in some embodiments, the data 328 can include default operating parameters and/or user-defined operating parameters. In this manner, as will be discussed in greater detail below, the controller 320 can be configured to determine a selected winding of the plurality of primary windings 316 based, at least in part, on the stored user-defined operating parameters and/or the stored default operating parameters.

Figure 10:
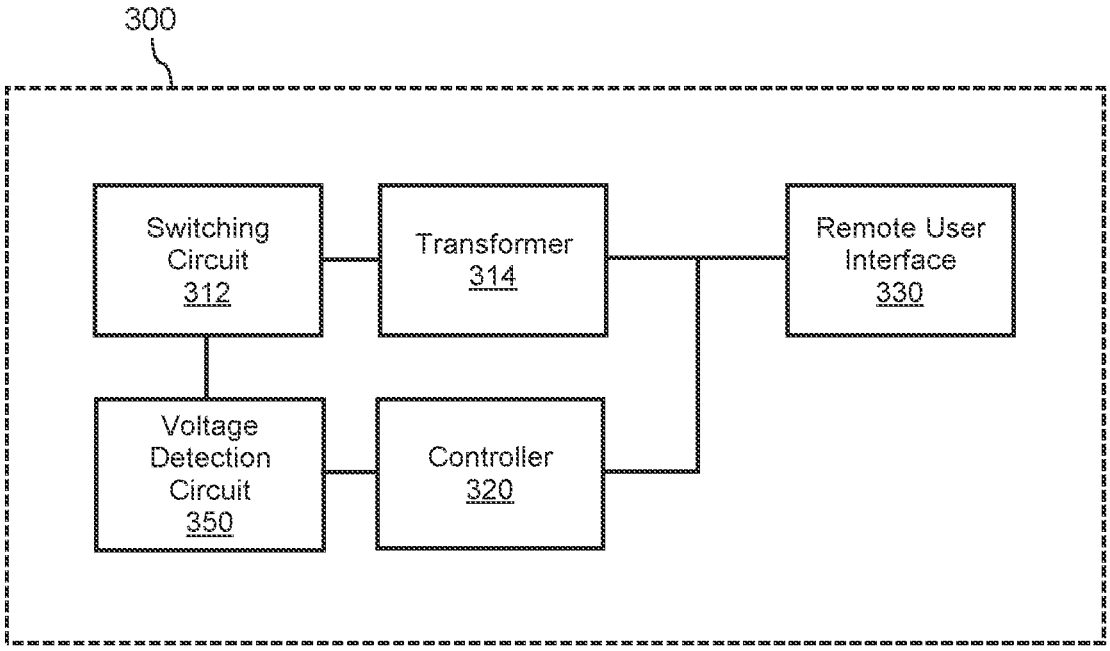
FIG. 10 depicts a block diagram of an example configuration of the air conditioning system of FIGS. 8-9 according to example embodiments of the present disclosure.
Figure 11:
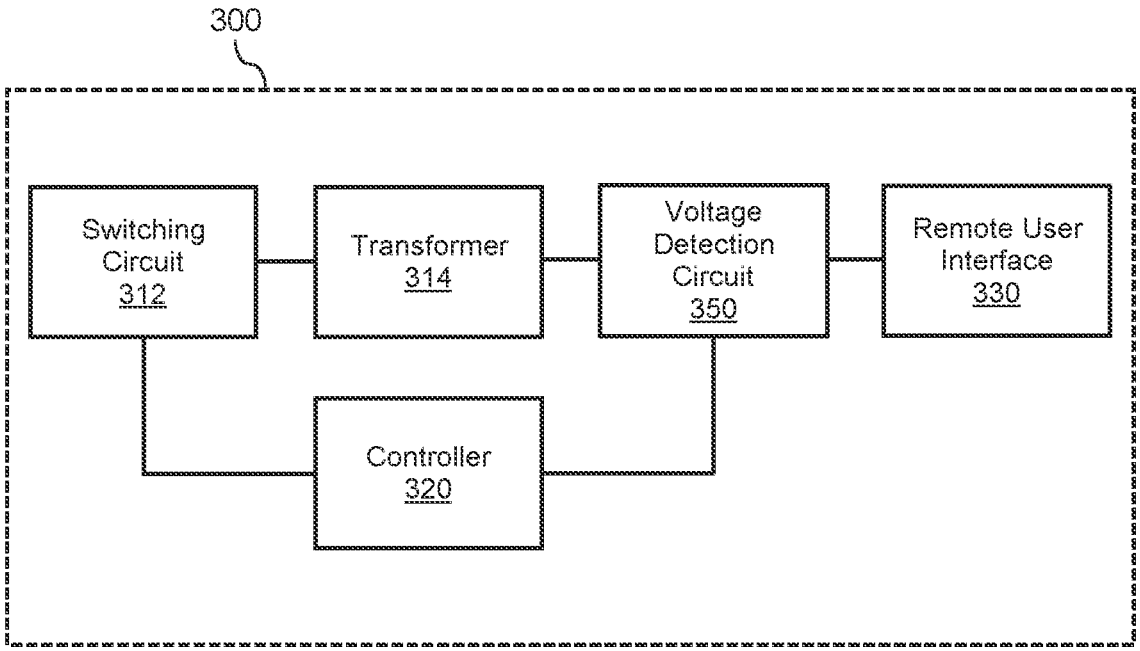
FIG. 11 depicts a block diagram of an example configuration of the air conditioning system of FIGS. 8-9 according to example embodiments of the present disclosure.
Figure 12:
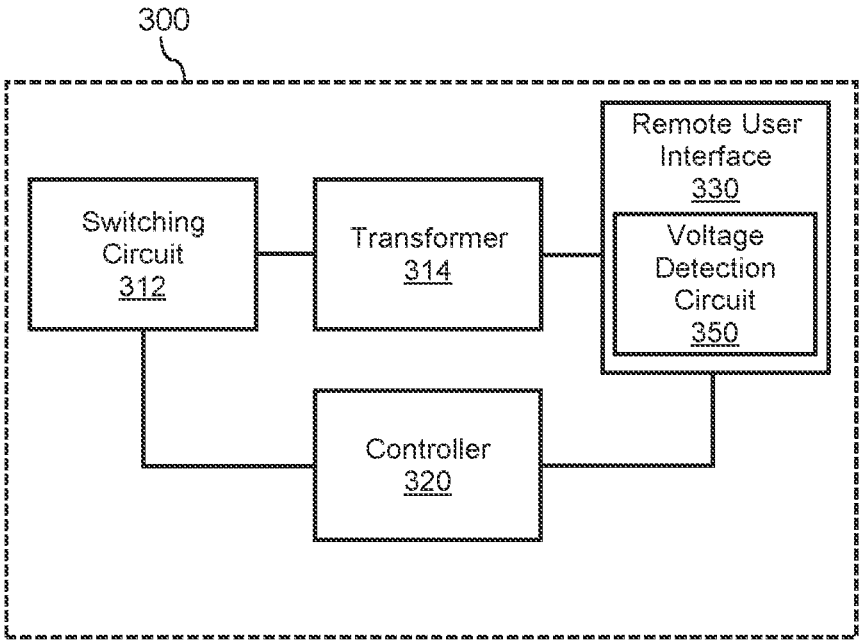
FIG. 12 depicts a block diagram of an example configuration of the air conditioning system of FIGS. 8-9 according to example embodiments of the present disclosure.

In some embodiments, the air conditioning system 300 can further include a voltage detection circuit 350 (FIGS. 10-12). Referring now to FIG. 10, in some embodiments, the air conditioning system 300 can include a voltage detection circuit 350 coupled to the primary side of the air conditioning system 300. More specifically, the voltage detection circuit 350 can be communicatively coupled to the controller 320 and the air conditioner unit 310. For instance, the voltage detection circuit 350 can be communicatively coupled to the controller 320 and the switching circuit 312. Additionally and/or alternatively, the voltage detection circuit 350 can be communicatively coupled to the controller 320 and the plurality of primary windings 316 of the linear transformer 314. In this manner, the voltage detection circuit 350 can be configured to detect output voltage from the air conditioner unit 310 and communicate data indicative of the detected output voltage to the controller 320. Based on the detected output voltage, the controller 320 can be configured to determine (e.g., detect) a high line voltage condition (e.g., when line voltage is greater than an upper operational voltage threshold) and/or a low line voltage condition (e.g., when line voltage is less than a lower operational voltage threshold). The controller 320 can then determine a selected winding of the plurality of primary windings 316 in response to detecting a high line voltage condition and/or a low line voltage condition. In this way, the air conditioning system 300 can be configured to switch the selected winding of the plurality of primary windings 316 in cases of high line voltage conditions and/or low line voltage conditions. An example method for controlling the air conditioning system 300 (as depicted in FIG. 10) is set forth and discussed below with reference to FIG. 14.

Referring now to FIG. 11, in some embodiments, the air conditioning system 300 can include the voltage detection circuit 350 coupled to the secondary side of the air conditioning system 300. More specifically, the voltage detection circuit 350 can be communicatively coupled to the controller 320 and the at least one secondary winding 318 of the linear transformer 314. Additionally and/or alternatively, the voltage detection circuit 350 can be communicatively coupled to the controller 320, the at least one secondary winding 318, and the user interface 330. In this manner, the voltage detection circuit 350 can be configured to detect output voltage from the air conditioner unit 310 and input voltage to the user interface 330. Furthermore, the voltage detection circuit 350 can be configured to communicate data indicative of the detected output voltage from the air conditioner unit 310 and/or the detected input voltage to the user interface 330 to the controller 320, and the controller 320 can be configured to determine the selected winding of the plurality of primary windings 316 based, at least in part, on the detected output voltage from the air conditioner unit 310 and/or the detected input voltage to the user interface 330. In some embodiments, the controller 320 can determine that the detected output voltage from the air conditioner unit 310 has dropped below and/or raised above a predetermined voltage threshold and, in response, can determine (e.g., switch) the selected winding of the plurality of primary windings 316. Additionally and/or alternatively, the controller 320 can determine that the detected input voltage to the user interface 330 has dropped below and/or risen above a predetermined voltage threshold (e.g., operational parameter) and, in response, can determine (e.g., switch) the selected winding of the plurality of primary windings 316. It should be noted that the data 328 stored in memory 324 can include the predetermined voltage thresholds. In this way, the air conditioning system 300 can be configured to switch the selected winding of the plurality of primary windings 316 in cases where the output voltage from the air conditioner unit 310 and/or input voltage to the user interface 330 sags below and/or exceeds a predetermined threshold. An example method for controlling the air conditioning system 300 (as depicted in FIG. 11) is set forth and discussed below with reference to FIG. 15.

Referring now to FIG. 12, in some embodiments, the air conditioning system 300 can include a user interface 330 communicatively coupled to the controller 320, and the user interface 330 can include the voltage detection circuit 350 therein. As noted above, the user interface 330 can include the communications module 332, thereby providing bidirectional communication capabilities to the user interface 330. In this manner, the voltage detection circuit 350 can be configured to detect input voltage to the user interface 330, and the user interface 330 can be configured to communicate data indicative of the detected input voltage to the controller 320. For instance, the voltage detection circuit 350 can detect a high voltage condition and/or a low voltage condition. In some embodiments, in response to the detected high voltage condition and/or the detected low voltage condition, the user interface 330 can be configured to send a signal (e.g., a voltage signal) to the controller 320, and the controller 320 can then determine (e.g., switch) the selected winding (e.g., determine an updated selected winding) in response to receiving the signal (e.g., voltage signal) from the user interface 330. Additionally and/or alternatively, in response to the detected high voltage condition and/or the detected low voltage condition, the user interface 330 can be configured to send data indicative of a request to change (e.g., switch) the selected winding to the controller 320, and the controller 320 can then determine (e.g., switch) the selected winding (e.g., determine an updated selected winding) in response to receiving the data indicative of the request from the user interface 330. In this way, the air conditioning system 300 can be configured to switch the selected winding of the plurality of primary windings 316 in cases of high input voltage conditions and/or low input voltage conditions to the user interface 330. Example methods for controlling the air conditioning system 300 (as depicted in FIG. 12) are set forth and discussed below with reference to FIGS. 16-17.

Although FIGS. 10-12 describe various exemplary configurations of the air conditioning system 300, it should be appreciated that modifications and variations can be made to the air conditioning system 300 without deviating from the scope of the present disclosure. For instance, the air conditioning system 300 can include more than one voltage detection circuit 350 coupled to the controller 320 and any suitable component of the air conditioning system 300. FIGS. 10-12 depict a single voltage detection circuit 350 coupled to the air conditioning system 300 merely for purposes of illustration and discussion.

Figure 13:
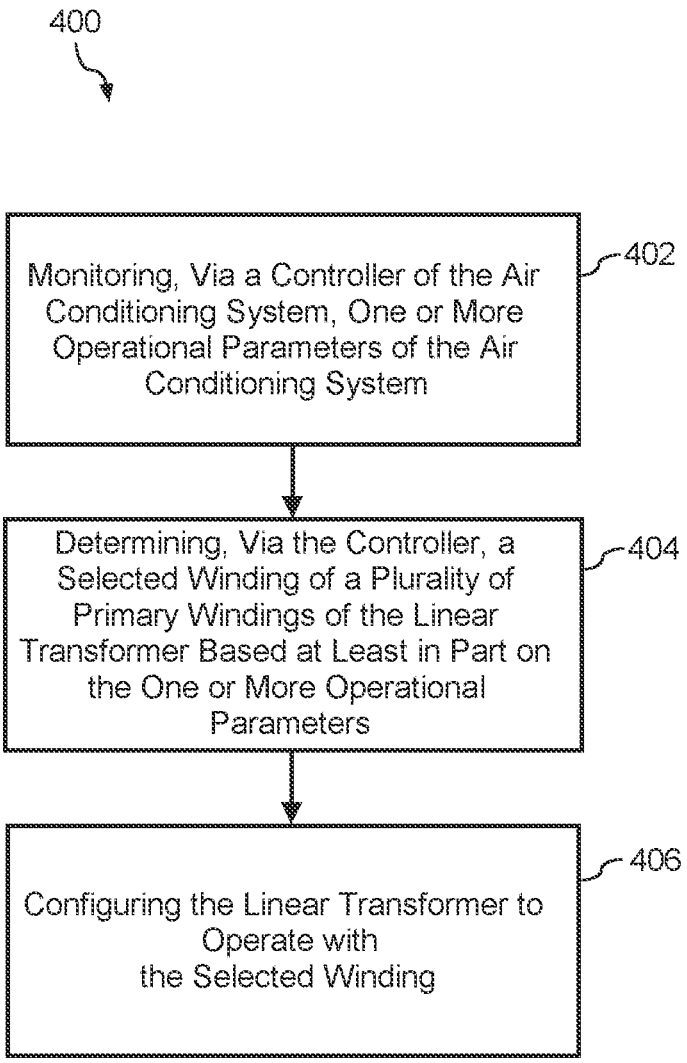
FIG. 13 depicts a flow chart diagram of an example method for controlling an air conditioning system according to example embodiments of the present disclosure.

Referring now to FIG. 13, a flow chart diagram of an example method 400 for controlling an air conditioning system is provided according to example embodiments of the present disclosure. The method 400 may be implemented as a brownout prevention operation in an air conditioning system such as, e.g., the air conditioning system 300 discussed above with reference to FIGS. 8-12. FIG. 13 depicts steps performed in a particular order for purposes of illustration and discussion. Those of ordinary skill in the art, using the disclosures provided herein, will understand that various steps of any of the methods described herein can be omitted, expanded, performed simultaneously, rearranged, and/or modified in various ways without deviating from the scope of the present disclosure. Furthermore, various steps (not illustrated) can be performed without deviating from the scope of the present disclosure. Additionally, the method 400 is discussed with reference to the air conditioner unit 100 discussed above with reference to FIGS. 1-6, the user interface 200 discussed above with reference to FIG. 7, and the air conditioning system 300 discussed above with reference to FIGS. 8-12. However, it should be understood that aspects of the present method 400 can find application with any suitable air conditioner unit, user interface, and/or air conditioning system.

The method 400 can include, at (402), monitoring, via a controller of the air conditioning system, one or more operational parameters of the air conditioning system. More particularly, a controller (e.g., controller 320) of an air conditioning system (e.g., air conditioning system 300) can be configured to monitor one or more operational parameters of the air conditioning system. The one or more operational parameters can include, e.g., one or more electrical characteristics associated with various components of the air conditioning system and/or the air conditioning system as a whole. For instance, in some embodiments, the one or more operational parameters can include output voltage of an air conditioner unit (e.g., air conditioner unit 310). In some embodiments, the one or more operational parameters can include input voltage to a user interface (e.g., user interface 330). In some embodiments, the one or more operational parameters can include high voltage conditions and/or low voltage conditions. In some embodiments, the one or more operational parameters can be user-defined operating parameters and/or default operating parameters. In some embodiments, the one or more operational parameters can include definition data (e.g., model number, expected voltage range(s), voltage rating(s)) associated with one or more components of the air conditioning system.

In some embodiments, the one or more operational parameters can be one or more electrical characteristics measured by one or sensors and/or detection devices (e.g., voltage detection circuit 350) of the air conditioning system. For instance, as noted above, the air conditioning system can include a linear transformer (e.g., linear transformer 314). The linear transformer can include a plurality of primary windings (e.g., primary windings 316) and at least one secondary winding (e.g., secondary winding 318) that respectively define a primary side and a secondary side of the air conditioning system. In some embodiments, the air conditioning system can include a voltage detection circuit coupled to a primary side of the air conditioning system (e.g., coupled to the plurality of primary windings 316 of the linear transformer 314). In such embodiments, the controller can be configured to receive voltage condition data (e.g., data indicative of a detected high line voltage condition, data indicative of a detected low line voltage condition) from the voltage detection circuit.

Additionally and/or alternatively, as noted above, the air conditioning system can include a voltage detection circuit coupled to a secondary side of the air conditioning system (e.g., coupled to the at least one secondary winding 318 of the linear transformer 314). In such embodiments, the controller can be configured to receive voltage data associated with the air conditioner unit (e.g., output voltage data) from the voltage detection circuit. Furthermore, responsive to receiving the output voltage data from the voltage detection circuit, the controller can be further configured to determine that the output voltage of the air conditioner unit is below a predetermined voltage threshold.

Additionally and/or alternatively, as noted above, the air conditioning system can include a user interface configured for bidirectional communication having a voltage detection circuit therein. In such embodiments, the controller can be configured to receive one or more signals from the user interface based, at least in part, on voltage data from the voltage detection circuit. More specifically, in some embodiments, the controller can be configured to receive a signal (e.g., voltage signal) from the user interface. Alternatively, in some embodiments, the controller can be configured to receive data indicative of a request from the user interface to change (e.g., switch) a selected winding of the plurality of primary windings.

The method 400 can include, at (404), determining, via the controller, a selected winding of a plurality of primary windings of the linear transformer based at least in part on the one or more operational parameters. More particularly, the controller (e.g., controller 320) can be configured to determine a selected winding of the plurality of primary windings (e.g., primary windings 316) of the linear transformer (e.g., linear transformer 314) based, at least in part, on the one or more operating parameters monitored at (402). For instance, in some embodiments, the controller can be configured to determine (e.g., switch) the selected winding of the plurality of primary windings in response to detecting a high line voltage condition and/or a low line voltage condition. Additionally and/or alternatively, in some embodiments, the controller can be configured to determine the selected winding of the plurality of primary windings in response to detecting the output voltage of the air conditioner unit (e.g., air conditioner unit 310) drop below and/or exceed a predetermined voltage threshold. Likewise, in some embodiments, the controller can be configured to determine the selected winding of the plurality of primary windings in response to detecting the input voltage to the user interface (e.g., user interface 330) drop below and/or exceed a predetermined voltage threshold.

Additionally and/or alternatively, the controller can be configured to determine the selected winding based, at least in part, on the signal (e.g., voltage signal) received from the user interface. In some embodiments, the controller can be configured to determine an updated selected winding of the plurality of primary windings based, at least in part, on the data indicative of the request from the user interface to change (e.g., switch) the selected winding of the plurality of windings.

Additionally and/or alternatively, the controller can be configured to determine the selected winding based, at least in part, on the stored definition data associated with the one or more components of the air conditioning system. Furthermore, in some embodiments, the controller can be configured to determine the selected winding based, at least in part, on one or more user-defined operating parameters and/or default operating parameters stored in memory. In such embodiments, as noted above, the one or more user-defined operating parameters can be selected by the user via, e.g., the user interface.

The method 400 can include, at (406), configuring the linear transformer to operate with the selected winding. More particularly, as noted above, the air conditioning system (e.g., air conditioning system 300) can include a switching circuit (e.g., switching circuit 312) communicatively coupled to the controller (e.g., controller 320) and to the plurality of primary windings of the linear transformer (e.g., primary windings 316 of linear transformer 314). As further noted above, the controller can configure the linear transformer to operate with the selected winding of the plurality of primary windings by transmitting one or more control signals to the switching circuit; the one or more control signals can include data indicative of the selected winding determined at (404). In this manner, the controller can control the output voltage from the air conditioner unit (e.g., air conditioner unit 310) to the user interface (e.g., user interface 330), thereby reducing brownout conditions in the air conditioning system.

For instance, in some embodiments, the controller can be configured to transmit the one or more control signals to the switching circuit in response to receiving the voltage condition data (e.g., data indicative of a high line voltage condition, data indicative of a low line voltage condition) from the voltage detection circuit (e.g., voltage detection circuit 350). In some embodiments, the controller can be configured to transmit the one or more control signals to the switching circuit in response to determining the output voltage of the air conditioner unit (e.g., air conditioner unit 310) and/or the input voltage to the user interface is below and/or exceeds the predetermined voltage threshold.

Additionally and/or alternatively, the controller can be configured to transmit the one or more control signals to the switching circuit in response to receiving the signal (e.g., voltage signal) from the user interface. Likewise, in some embodiments, the controller can be further configured to transmit the one or more control signals to the switching circuit in response to receiving the data indicative of the request from the user interface to change (e.g., switch) the selected winding; in such embodiments, the one or more control signals can include data indicative of the updated selected winding determined at (404).

Additionally and/or alternatively, the controller can be configured to transmit the one or more control signals to the switching circuit based, at least in part, on the stored definition data associated with the one or more components of the air conditioning system. Furthermore, in some embodiments, the controller can be configured to transmit the one or more control signals to the switching circuit based, at least in part, on the user-defined operating parameters and/or default operating parameters stored in memory.

Figure 14:
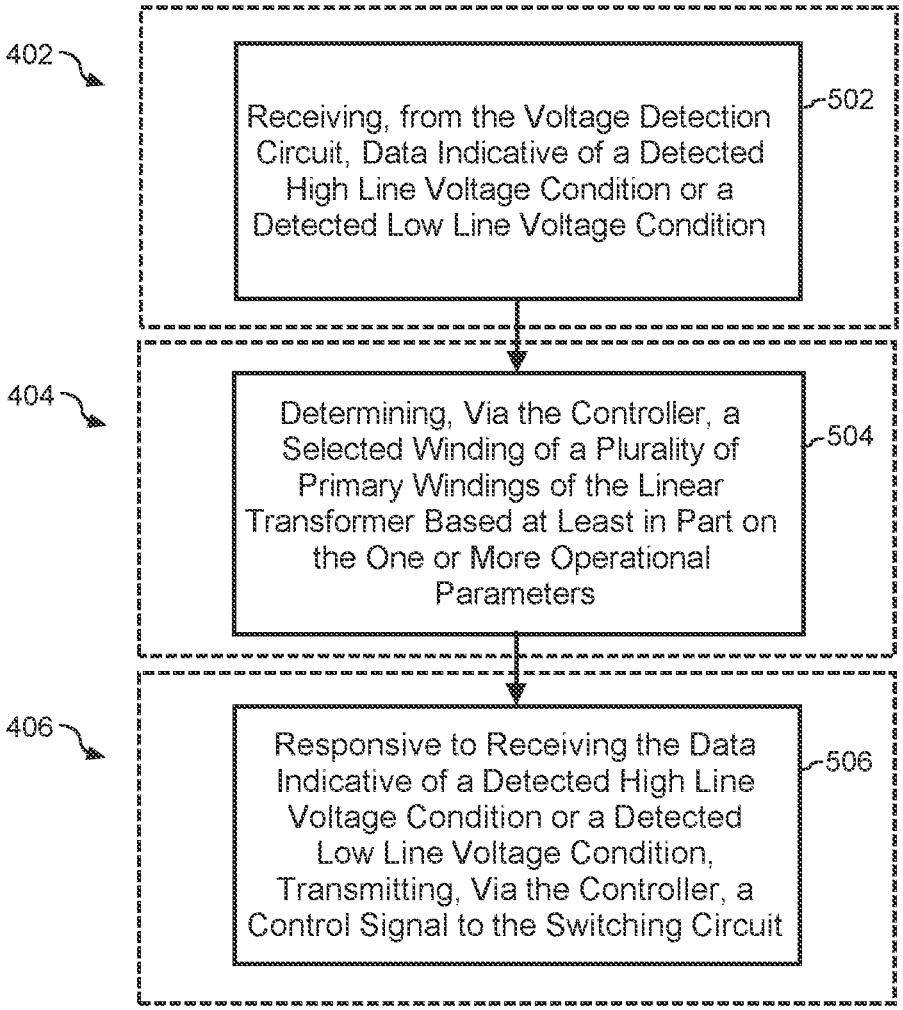
FIG. 14 depicts a flow chart diagram of an example method for controlling an air conditioning system according to example embodiments of the present disclosure.

As an illustrative example, FIG. 14 depicts the example method 400 for controlling an air conditioning system (e.g., air conditioning system 300) having a detection device (e.g., voltage detection circuit 350) coupled to a primary side of a linear transformer (e.g., defined by the plurality of primary windings 316 of linear transformer 314). More specifically, FIG. 14 depicts the example method 400 for controlling the air conditioning system 300 having the example configuration depicted in FIG. 10. FIG. 14 depicts steps performed in a particular order for purposes of illustration and discussion. Those of ordinary skill in the art, using the disclosures provided herein, will understand that various steps of any of the methods described herein can be omitted, expanded, performed simultaneously, rearranged, and/or modified in various ways without deviating from the scope of the present disclosure. Furthermore, various steps (not illustrated) can be performed without deviating from the scope of the present disclosure.

Referring to FIG. 14 at (502), the controller (e.g., controller 320) of the air conditioning system can be configured to receive data indicative of a detected high line voltage condition and/or a detected low line voltage condition from the voltage detection circuit. As noted above, high line voltage conditions arise when the line voltage of the air conditioning system is greater than an upper operational voltage threshold. Likewise, low line voltage conditions arise when the line voltage of the air conditioning system is less than a lower operational voltage threshold. In some embodiments, the controller can receive voltage data from the voltage detection circuit and, in response, determine whether a high line voltage condition and/or a low line voltage condition exists. Alternatively, in some embodiments, the voltage detection circuit can determine whether a high line voltage condition and/or a low line voltage condition exists and, in response, transmit data indicative of the determination to the controller.

Referring to FIG. 14 at (504), the controller of the air conditioning system can be configured to determine (e.g., switch) a selected winding of the plurality of primary windings of the linear transformer based, at least in part, on the data received from the voltage detection circuit at (502). For instance, the controller can update the selected winding of the plurality of primary windings of the linear transformer in response to a high line voltage condition and/or a low line voltage condition.

Referring to FIG. 14 at (506), the controller of the air conditioning system can be configured to transmit a control signal to a switching circuit (e.g., switching circuit 312) of the air conditioning system in response to receiving the data from the voltage detection circuit at (502) and determining the selected winding at (504). Furthermore, the control signal can include data indicative of the selected winding determined at (504). In this way, the controller can control the output voltage of an air conditioner unit (e.g., air conditioner unit 310) of the air conditioning system in order to prevent brownout conditions in the air conditioning system.

Figure 15:
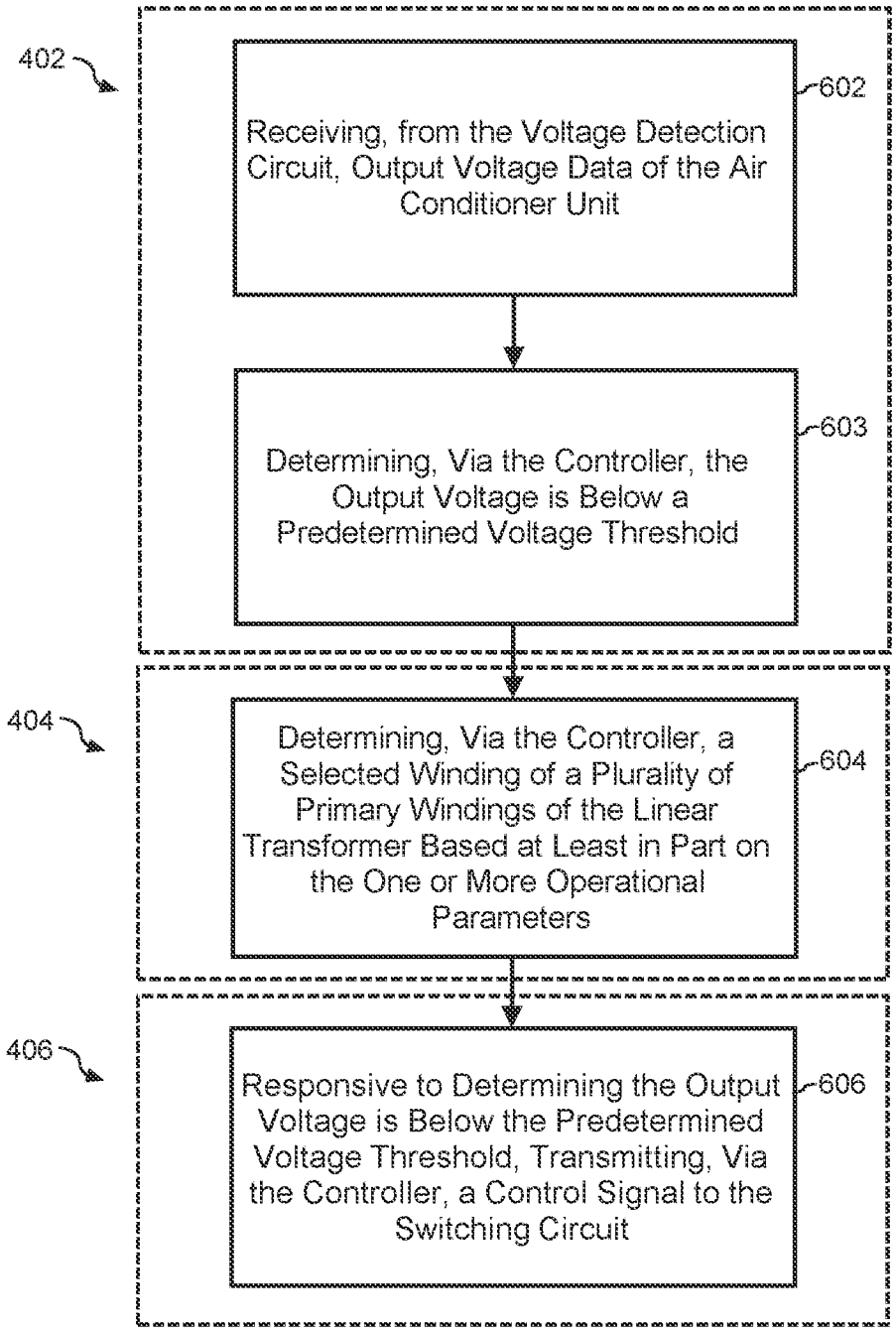
FIG. 15 depicts a flow chart diagram of an example method for controlling an air conditioning system according to example embodiments of the present disclosure.

As an additional illustrative example, FIG. 15 depicts the example method 400 for controlling an air conditioning system (e.g., air conditioning system 300) having a detection device (e.g., voltage detection circuit 350) coupled to a secondary side of a linear transformer (e.g., defined by the at least one secondary windings 318 of linear transformer 314). More specifically, FIG. 15 depicts the example method 400 for controlling the air conditioning system 300 having the example configuration depicted in FIG. 11. FIG. 15 depicts steps performed in a particular order for purposes of illustration and discussion. Those of ordinary skill in the art, using the disclosures provided herein, will understand that various steps of any of the methods described herein can be omitted, expanded, performed simultaneously, rearranged, and/or modified in various ways without deviating from the scope of the present disclosure. Furthermore, various steps (not illustrated) can be performed without deviating from the scope of the present disclosure.

Referring to FIG. 15 at (602), the controller (e.g., controller 320) of the air conditioning system can be configured to receive output voltage data of an air conditioner unit (e.g., output voltage data of air conditioner unit 310) of the air conditioning system from the voltage detection circuit. Furthermore, in response to receiving the output voltage data at (602), the controller can be configured to determine that the output voltage of the air conditioner unit is below a predetermined voltage threshold at (603). As noted above, the controller can make the determination at (603) based, at least in part, on voltage threshold data stored in its memory (e.g., memory 324).

Referring to FIG. 15 at (604), the controller of the air conditioning system can be configured to determine (e.g., switch) a selected winding of the plurality of primary windings of the linear transformer based, at least in part, on the data received from the voltage detection circuit at (602) and the voltage threshold determination made at (603). For instance, the controller can update the selected winding of the plurality of primary windings of the linear transformer in response to the output voltage of the air conditioner unit dropping below the predetermined voltage threshold.

Referring to FIG. 15 at (606), the controller of the air conditioning system can be configured to transmit a control signal to a switching circuit (e.g., switching circuit 312) of the air conditioning system in response to determining that the output voltage of the air conditioner unit is below the predetermined voltage threshold at (603) and determining the selected winding at (604). Furthermore, the control signal can include data indicative of the selected winding determined at (604). In this way, the controller can control the output voltage of the air conditioner in order to prevent brownout conditions in the air conditioning system.

Figure 16:
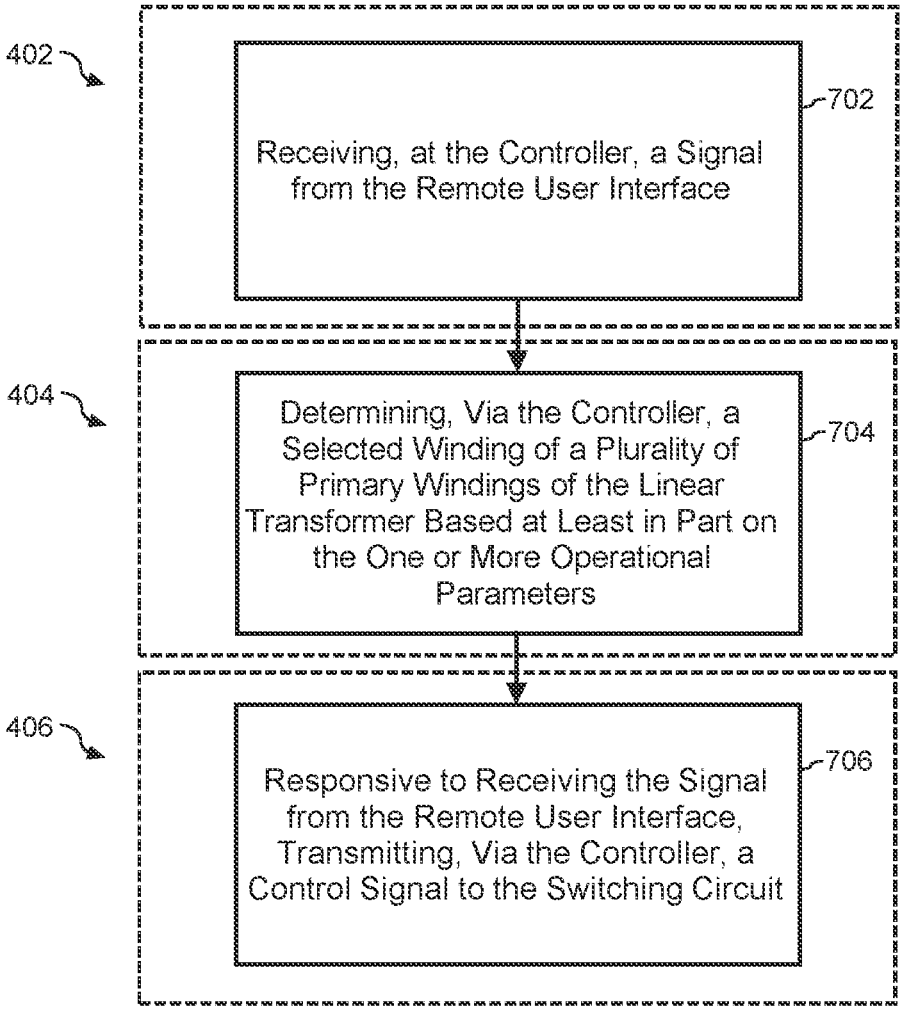
FIG. 16 depicts a flow chart diagram of an example method for controlling an air conditioning system according to example embodiments of the present disclosure.

As an additional illustrative example, FIG. 16 depicts the example method 400 for controlling an air conditioning system (e.g., air conditioning system 300) having a remote user interface (e.g., user interface 330) that includes a detection device (e.g., voltage detection circuit 350). More specifically, FIG. 16 depicts the example method 400 for controlling the air conditioning system 300 having the example configuration depicted in FIG. 12. FIG. 16 depicts steps performed in a particular order for purposes of illustration and discussion. Those of ordinary skill in the art, using the disclosures provided herein, will understand that various steps of any of the methods described herein can be omitted, expanded, performed simultaneously, rearranged, and/or modified in various ways without deviating from the scope of the present disclosure. Furthermore, various steps (not illustrated) can be performed without deviating from the scope of the present disclosure.

Referring to FIG. 16 at (702), the controller (e.g., controller 320) of the air conditioning system can be configured to receive one or more signals from the remote user interface. As noted above, the remote user interface can include the voltage detection circuit and can be configured for bidirectional communication with the controller. In some embodiments, the remote user interface can be configured to transmit a signal (e.g., voltage signal) to the controller based on the input voltage (e.g., at the remote user interface) detected by the voltage detection circuit.

Referring to FIG. 16 at (704), the controller of the air conditioning system can be configured to determine (e.g., switch) a selected winding of the plurality of primary windings of the linear transformer based, at least in part, on the signal received from the remote user interface at (702). For instance, the controller can update the selected winding of the plurality of primary windings of the linear transformer in response to the voltage detection circuit detecting a high voltage condition and/or a low voltage condition at the remote user interface.

Referring to FIG. 16 at (706), the controller of the air conditioning system can be configured to transmit a control signal to a switching circuit (e.g., switching circuit 312) of the air conditioning system in response to receiving the signal from the remote user interface at (702) and determining the selected winding at (704). Furthermore, the control signal can include data indicative of the selected winding determined at (704). In this way, the controller can control the output voltage of an air conditioner unit (e.g., air conditioner unit 310) of the air conditioning system in order to prevent brownout conditions in the air conditioning system.

Figure 17:
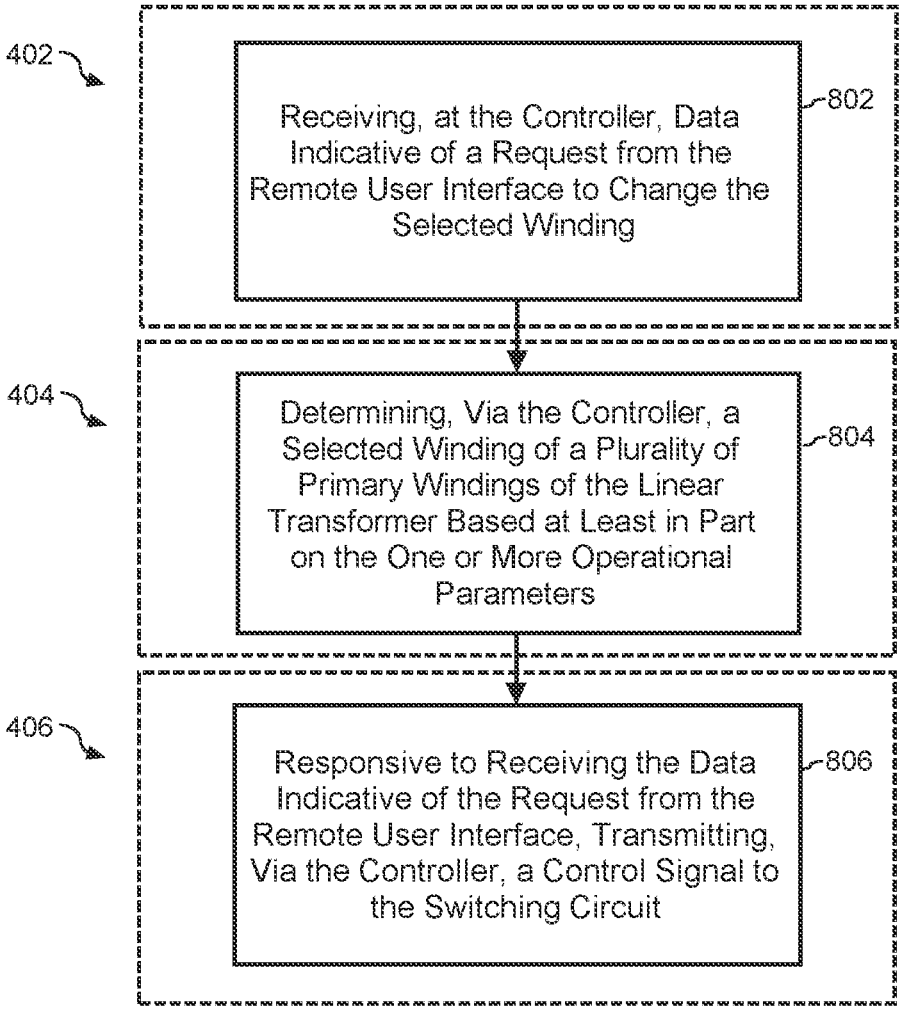
FIG. 17 depicts a flow chart diagram of an example method for controlling an air conditioning system according to example embodiments of the present disclosure.

As an additional illustrative example, FIG. 17 depicts the example method 400 for controlling an air conditioning system (e.g., air conditioning system 300) having a remote user interface (e.g., user interface 330) that includes a detection device (e.g., voltage detection circuit 350). More specifically, FIG. 17 depicts the example method 400 for controlling the air conditioning system 300 having the example configuration depicted in FIG. 12. FIG. 17 depicts steps performed in a particular order for purposes of illustration and discussion. Those of ordinary skill in the art, using the disclosures provided herein, will understand that various steps of any of the methods described herein can be omitted, expanded, performed simultaneously, rearranged, and/or modified in various ways without deviating from the scope of the present disclosure. Furthermore, various steps (not illustrated) can be performed without deviating from the scope of the present disclosure.

Referring to FIG. 17 at (802), the controller (e.g., controller 320) of the air conditioning system can be configured to receive one or more signals from the remote user interface. As noted above, the remote user interface can include the voltage detection circuit and can be configured for bidirectional communication with the controller. In some embodiments, the remote user interface can be configured to transmit data indicative of a selected winding update request to the controller based on the input voltage (e.g., at the remote user interface) detected by the voltage detection circuit. Furthermore, the selected winding update request can be indicative of a request by the remote user interface to change (e.g., switch) a selected winding of the plurality of primary windings of the linear transformer.

Referring to FIG. 17 at (804), the controller of the air conditioning system can be configured to determine an updated selected winding of the plurality of primary windings of the linear transformer based, at least in part, on the selected winding update request received from the remote user interface at (802). For instance, the remote user interface can request that the selected winding be updated in response to the voltage detection circuit detecting a high voltage condition and/or a low voltage condition at the remote user interface.

Referring to FIG. 17 at (806), the controller of the air conditioning system can be configured to transmit a control signal to a switching circuit (e.g., switching circuit 312) of the air conditioning system in response to receiving the selected winding update request from the remote user interface at (802) and determining the updated selected winding at (804). Furthermore, the control signal can include data indicative of the updated selected winding determined at (804). In this way, the controller can control the output voltage of an air conditioner unit (e.g., air conditioner unit 310) of the air conditioning system in order to prevent brownout conditions in the air conditioning system.

While the present subject matter has been described in detail with respect to specific example embodiments thereof, it will be appreciated that those skilled in the art, upon attaining an understanding of the foregoing can readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An air conditioning system comprising:

an air conditioner unit comprising:

a linear transformer comprising a plurality of primary windings and at least one secondary winding respectively defining a primary side and a secondary side of the air conditioning system; and a switching circuit coupled to the plurality of primary windings;

a remote user interface coupled to the at least one secondary winding; and a controller operably coupled to the air conditioner unit and the remote user interface, the controller configured to control output voltage from the air conditioner unit to the remote user interface by performing operations comprising:

monitoring one or more operational parameters of the air conditioning system;

determining a selected winding of the plurality of primary windings based at least in part on the one or more operational parameters;

transmitting a control signal to the switching circuit to configure the linear transformer to operate with the selected winding, the control signal comprising data indicative of the selected winding.

2. The air conditioning system of claim 1, further comprising a voltage detection circuit coupled to the primary side of the air conditioning system.

3. The air conditioning system of claim 2, wherein the controller is configured to determine the selected winding in response to detecting a high line voltage condition.

4. The air conditioning system of claim 2, wherein the controller is configured to determine the selected winding in response to detecting a low line voltage condition.

5. The air conditioning system of claim 1, further comprising a voltage detection circuit coupled to the secondary side of the air conditioning system.

6. The air conditioning system of claim 5, wherein the controller is configured to determine the selected winding in response to detecting output voltage of the air conditioner unit drop below a predetermined voltage threshold.

7. The air conditioning system of claim 1, further comprising a voltage detection circuit coupled to the remote user interface, wherein the remote user interface is communicatively coupled to the controller.

8. The air conditioning system of claim 7, wherein:

the remote user interface is configured to send a signal to the controller, and the controller is configured to transmit the control signal to the switching circuit in response to receiving the signal from the remote user interface, the control signal comprising data indicative of the selected winding.

9. The air conditioning system of claim 7, wherein:

the remote user interface is configured to send, to the controller, data indicative of a request to change the selected winding, and the controller is configured to transmit the control signal to the switching circuit in response to receiving the data indicative of the request to change the selected winding from the remote user interface, the control signal comprising data indicative of an updated selected winding.

10. The air conditioning system of claim 1, wherein the controller is configured to store definition data associated with the air conditioner unit and determine the selected winding based, at least in part, on the definition data associated with the air conditioner unit.

11. The air conditioning system of claim 1, wherein the controller is configured to determine the selected winding based on one or more user-defined operating parameters.

12. The air conditioning system of claim 1, wherein the air conditioner unit is a single-package vertical unit (SPVU).

13. The air conditioning system of claim 1, wherein the air conditioner unit is a package terminal air conditioner (PTAC).

14. A method for controlling an air conditioning system including an air conditioner unit and a remote user interface, the air conditioner unit comprising a linear transformer and a switching circuit, the method comprising:

monitoring, via a controller of the air conditioning system, one or more operational parameters of the air conditioning system;

determining, via the controller, a selected winding of a plurality of primary windings of the linear transformer based at least in part on the one or more operational parameters; and transmitting, via the controller, a control signal to the switching circuit to configure the linear transformer to operate with the selected winding, the control signal comprising data indicative of the selected winding.

15. The method of claim 14, wherein the air conditioning system further comprises a voltage detection circuit coupled to the plurality of primary windings, the method further comprising:

receiving, from the voltage detection circuit, data indicative of a detected high line voltage condition or a detected low line voltage condition; and responsive to receiving the data indicative of a detected high line voltage condition or a detected low line voltage condition, transmitting, via the controller, the control signal to the switching circuit, the control signal comprising data indicative of the selected winding.

16. The method of claim 14, wherein the air conditioning system further comprises a voltage detection circuit coupled to at least one secondary winding of the linear transformer, the method further comprising:

receiving, from the voltage detection circuit, output voltage data of the air conditioner unit;

responsive to receiving the output voltage data, determining, via the controller, the output voltage is below a predetermined voltage threshold; and responsive to determining the output voltage is below the predetermined voltage threshold, transmitting, via the controller, the control signal to the switching circuit, the control signal comprising data indicative of the selected winding.

17. The method of claim 14, wherein the air conditioning system further comprises a voltage detection circuit coupled to the remote user interface, the method further comprising:

receiving, at the controller, a signal from the remote user interface; and responsive to receiving the signal from the remote user interface, transmitting, via the controller, the control signal to the switching circuit, the control signal comprising data indicative of the selected winding.

18. The method of claim 14, wherein the air conditioning system further comprises a voltage detection circuit coupled to the remote user interface, the method further comprising:

receiving, at the controller, data indicative of a request from the remote user interface to change the selected winding; and responsive to receiving the data indicative of the request from the remote user interface, transmitting, via the controller, the control signal to the switching circuit, the control signal comprising data indicative of an updated selected winding of the plurality of primary windings of the linear transformer.

19. A control system for an air conditioning system including an air conditioner unit and a remote user interface, the air conditioner unit comprising a linear transformer and a switching circuit, the control system configured to reduce brownout conditions in the air conditioning system by performing operations, the operations comprising:

monitoring one or more operational parameters of the air conditioning system;

determining, via the controller, a selected winding of a plurality of primary windings of the linear transformer based at least in part on the one or more operational parameters; and transmitting, via the controller, a control signal to the switching circuit to configure the linear transformer to operate with the selected winding, the control signal comprising data indicative of the selected winding.

* * * * *